US009028161B2

(12) United States Patent
Stredak et al.

(10) Patent No.: US 9,028,161 B2
(45) Date of Patent: May 12, 2015

(54) RECTANGULAR WIPER FOR FLAT BRUSHES

(75) Inventors: Helmut Stredak, Aurach (DE); Manuela Geuther, Ansbach (DE); Erwin Schuster, Bechhofen (DE)

(73) Assignee: GEKA GmbH, Bechhofen (DE)

( * ) Notice: Subject to any disclaimer, the term of this patent is extended or adjusted under 35 U.S.C. 154(b) by 713 days.

(21) Appl. No.: 13/282,318

(22) Filed: Oct. 26, 2011

(65) Prior Publication Data

US 2012/0148332 A1 Jun. 14, 2012

(30) Foreign Application Priority Data

Oct. 27, 2010 (DE) ..... 20 2010 014 791 U

(51) Int. Cl.
*A46B 11/00* (2006.01)
*A45D 40/26* (2006.01)

(52) U.S. Cl.
CPC ..... *A45D 40/267* (2013.01)

(58) Field of Classification Search
CPC . A45D 34/042; A45D 34/043; A45D 34/045; A45D 34/046; A45D 34/047; A45D 40/262; A45D 40/264; A45D 40/265; A45D 40/267; A45D 40/268
USPC ..... 401/121, 122, 126–130
See application file for complete search history.

(56) References Cited

U.S. PATENT DOCUMENTS

| | | | | |
|---|---|---|---|---|
| 4,470,425 | A * | 9/1984 | Gueret | 132/218 |
| 5,309,929 | A * | 5/1994 | Toll | 132/218 |
| 5,743,279 | A * | 4/1998 | Gueret | 132/218 |
| 5,951,185 | A | 9/1999 | Kingsford et al. | |
| 6,076,531 | A * | 6/2000 | Gueret | 132/218 |
| 6,328,495 | B1 * | 12/2001 | Gueret | 401/122 |

FOREIGN PATENT DOCUMENTS

| | | |
|---|---|---|
| DE | 69815413 | 5/2004 |
| FR | 2777431 | 10/1999 |

* cited by examiner

*Primary Examiner* — David Walczak

(57) ABSTRACT

A wiper for wiping off a cosmetics applicator during the withdrawal from its storage container, wherein the wiper forms a substantially rectangular passage, which in the non-stressed state is closed off by two mutually opposing wiper lips that are respectively divided into several bending elements which are elastically deformed when the cosmetics applicator is pushed through and thus clear the way for the applicator to pass through the passage.

14 Claims, 5 Drawing Sheets

RECTANGULAR WIPER FOR FLAT BRUSHES

FIELD OF THE INVENTION

The invention relates to a wiper for wiping off a cosmetics applicator during withdrawal from a storage container.

BACKGROUND OF THE INVENTION

When they are not used, cosmetics applicators and primarily mascara applicators protrude into a storage container in which the cosmetic to be applied is located. It is thus ensured that the cosmetics applicator is available copiously charged with the cosmetic. The charge of the cosmetics applicator is enhanced in many cases by the fact that the cosmetics unit is not only placed, "cap up and bottom down", on the tray of the washing basin in the bathroom at home, but that it is in mobile use and is transported for this purpose in the handbag.

Therefore, it must be ensured that the cosmetics applicator, when withdrawn from the storage container, is always charged with exactly the right amount of cosmetic and does not "pull out" an excess of cosmetic from the storage container.

Usually wipers are provided for this purpose.

Usually, such wipers, in the broadest sense, have the contour and function of an anus, i.e., they comprise an annular wiper lip which places itself tightly around the shaft of the cosmetics applicator by means of which the cosmetics applicator protrudes into the storage container when it is not used.

Once the wiper is withdrawn from the storage container, the excess amount of the cosmetic adhering to the applicator shaft and the actual applicator is wiped off.

Such annular wipers can be controlled well in practice and therefore do not present any difficulties any more, because suitable wiper designs are available for various cases of application. In recent times, however, there was a call for alternative cosmetics applicators that offer a completely new feel of use. In this context, flat cosmetics applicators were developed, in particular also for the purpose of applying mascara, which correspond rather to a paintbrush as regards their appearance, and which are, however, designed in such a way that, upon closer inspection, they combine the advantages of use of the classical mascara applicators and in particular their brush-like behavior, which guarantees excellent combing and separating capability, with the handling of a paint brush often perceived as advantageous and with its appealing, fresh design.

However, the construction of wipers for such flat applicators entails some challenges. For the length of the contact line in such flat applicators between the wiper and the applicator is several times greater than in known applicators, which is why a substantially greater friction occurs that causes the wider, and thus more unstable wiper much sooner to "turn inside-out" and then exhibit an only unsatisfactory wiping action.

Internal attempts have already been made to counteract this undesirable "turning inside-out" by making the wiper more rigid as a whole. However, this leads to the user having to exert considerable forces in order to pull out the cosmetics applicator towards the outside through the rigid wiper, which develops relatively large frictional forces due to its long contact line. It can hardly be avoided that an abrupt tactile impression is produced upon withdrawing the applicator, because the forces required for the withdrawal of the applicator suddenly become much smaller once the applicator has come out of engagement with the wiper.

It is at least as serious a problem that such flat applicators, in particular in cases where they are used for applying mascara, comprise a bristle covering that can easily be damaged by a wiper that is too rigid.

In light of this, it is the object of the invention to provide a wiper for a flat cosmetics applicator that has an improved effect, in particular in the form of better characteristics during insertion and withdrawal of the flat applicator.

SUMMARY OF THE INVENTION

This object is accomplished by the fact that the wiper forms a preferably substantially rectangular passage, which in the non-stressed state is closed off by two mutually opposing wiper lips that are respectively divided themselves into several bending elements which are elastically deformed when the cosmetics applicator is pushed through and thus clear the way for the applicator to pass through the passage.

Most frequently, it is provided according to the invention that the wiper lips in the non-stressed state have a contour in the direction of its longitudinal axes LS 1 or LS 2 that is at least substantially, preferably even completely straight, apart from tolerance-related deviations or deformations caused by the period of use. The contour may be referred to as being substantially straight if the average radius of curvature of the longitudinal axes is less than 40 mm and preferably even less than 60 mm. Preferably, said longitudinal axes LS 1 and 2 extend parallel to the dividing line T between the wiper lips.

A passage whose edges have a slightly wave-like contour or whose edges correspond only approximately to a rectangle because they are spherical or convex, but nevertheless substantially form a rectangle, is also a rectangular passage within the meaning of the invention.

Within the context of a preferred embodiment it is provided that the bending elements form a first section of the wiper lip and transition into a base section of the wiper lip that forms the second section of the wiper lip and thus prevents the wiper lip from becoming too soft. Such a wiper lip of a "two-part design" or divided into two sections retains its usual hardness in the base area and makes allowances for the susceptibility of the bristles to kinking only in its outer area by means of the bending elements.

Another preferred embodiment provides that two or preferably several bending elements of a wiper lip, adjacent to their root, unify to form a combined tab. In this case, a wiper lip then consists of several tabs which preferably do not touch one another or at least do not touch one another over a more than only inconsiderable part of their flanks.

By forming such tabs, the flexibility of the wiper lip is further reduced, i.e. the wiper lip becomes capable of fitting more snugly. Preferably, vent holes are provided at the same time through which the interior of the cosmetics storage container communicates with the outside environment so that no or no substantial negative pressure forms when the wiper is withdrawn, and conversely, no or no substantial overpressure forms when the wiper is inserted.

Within the context of another preferred embodiment it is provided that the bending elements taper from their base area towards their free end (seen in the direction of the maximum usable length LM). Preferably, they are designed as triangular tongues. A gap is respectively located between these triangular tongues. Similarly, substantially rectangular tongues between which, preferably, a gap is also respectively formed can be used. Optionally, a mixture of different tongue geometries is possible. Predominantly or exclusively triangular tongues are preferred due to their capability of better guiding applicator bristles that are sliding past.

Another preferred exemplary embodiment provides that the triangular tongues of mutually opposing wiper lips are disposed with an offset rapport or an offset. It is thus prevented that two gaps between mutually opposing pairs of triangular tongues oppose each other at a time, thus forming free areas that are too large and through which the barrier effect of the wiper can be overcome by the cosmetic.

In the context of another preferred embodiment, it is provided that the longitudinal axis of the bending elements is inclined at an angle of 82° to 50° relative to the longitudinal axis of the wiper.

In the context of another preferred embodiment, it is provided that the thickness of the bending elements (measured approximately in the direction of the longitudinal axis of the wiper) decreases from the root of the bending element towards the free end of the bending element, preferably by at least 10%, ideally by at least 25% of the thickness of the bending element at its root.

In the context of another preferred embodiment, it is provided that the narrowest side of the triangular tongues forms their root with which the triangular tongues are respectively connected to the rest of the body of the wiper or to the base section of the wiper lip in the manner of unilaterally cantilevered bending beams.

Basically, it is conceivable that the bending elements themselves have the form of closely spaced bristles that are preferably disposed in several rows one behind the other in the insertion direction. Thus, the bending elements can respectively constitute a bristle curtain that presents itself substantially as a linear strip, consisting of individual bristles with a base diameter, which is defined more closely below, of ≤0.2 mm. The distances between the bristles are the result of the required wiping action and are to be determined by tests that are common in the field. Preferably, bristles attached by injection-molding are used.

Clearly preferably, the bending elements are not bristles, but significantly more massive. At least in their base area at which they transition into the basic wiper body (distally of a possible hollow/rounded portion between the bending element and the wiper body), in the direction of the maximum usable length LM, they have a width which is ≥0.4 mm, better ≥0.8 mm and partially ≥1.5 mm.

Further advantages, mechanisms of action and optional embodiments become apparent from the following description of the three exemplary embodiments explained by the Figures.

DETAILED DESCRIPTION OF THE PREFERRED EMBODIMENTS

Figure 1:
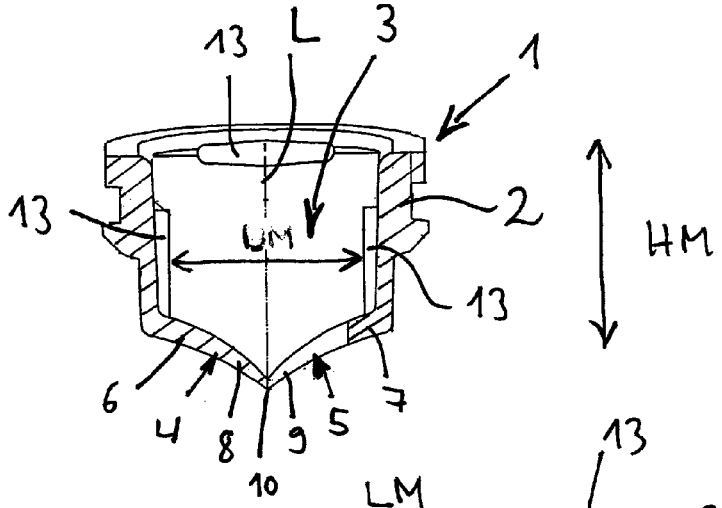
FIG. 1: a section through a first exemplary embodiment of the wiper according to the invention along the line of cut B-B.
Figure 2:
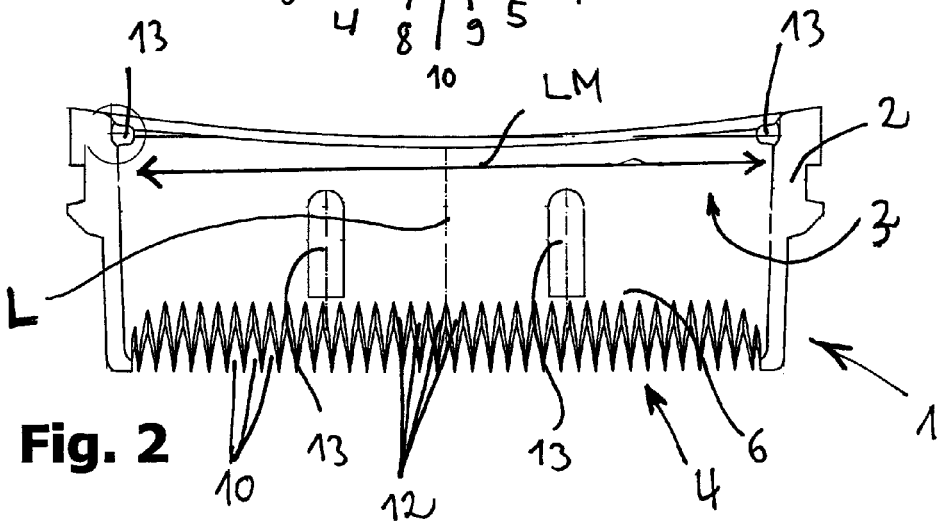
FIG. 2: a section of the same exemplary embodiment along the line of cut A-A.
Figure 3:
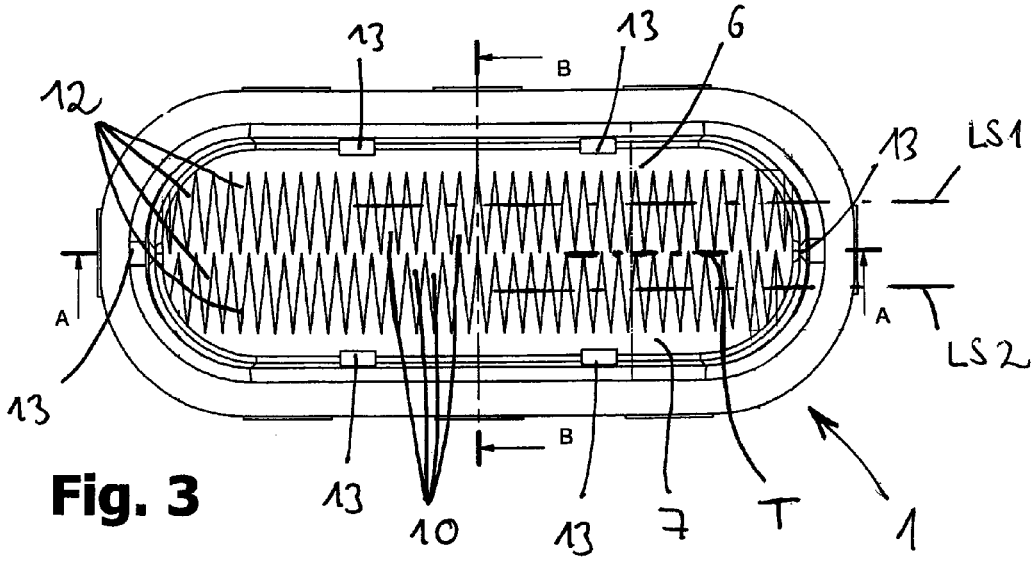
FIG. 3: a top view of a wiper according to the first exemplary embodiment.

As can be seen in the FIGS. 1 to 3, the basic wiper body 2 forming the predominant part of the wiper 1 is designed as a sleeve which encircles a passage 3 for a cosmetics applicator that is not shown, and which extends in the direction of a longitudinal axis L. The wiper can be referred to as being rectangular with rounded-off corners, if required. The important feature is that the wiper has two short sides and, substantially perpendicular thereto, two long sides that are longer than the short sides by at least the factor 1.5, better by at least the factor 1.8, and ideally by the factor 2. Of course, the long sides, in particular, do not strictly have to be straight in the mathematical sense; they may, for reasons of design or patent law, also have a slightly wavy design, for example, without departing from the term "rectangular", which is to be understood in the broadest sense—even if such a design is only peripherally in accordance with the invention since it entails an increased production effort.

The wiper according to the invention, which is to be used for the field of cosmetics, differs at least by its delicate design from wipers that are used for totally different purposes in other technical fields:

The sleeve has a maximum height HM of up to 22 mm, better up to only 18 mm, preferably, however, the maximum height HM is limited to 13 mm. The basic wiper body 2 is designed in such a manner that the passage, in a first direction perpendicular to said longitudinal axis L, has a usable maximum length LM of 15 mm to 55 mm, or only 15 mm to 40 mm, preferably only of 15 mm to 30 mm. In a second direction perpendicular to the first direction and to the longitudinal axis, the passage has a usable maximum width BM of 2.5 mm to 10 mm, preferably of 3 mm to 8 mm.

As can be seen in FIG. 3, the passage, in the non-stressed state, i.e. when the cosmetics applicator is not in use, is closed off by two—preferably only two—mutually opposing wiper lips 4 and 5. These wiper lips are respectively composed of a base section 6 or 7 and an actual lip section 8 or 9. The wiper lips are characterized by being substantially configured as straight strips that enclose between them an imaginary linear dividing line T. For reasons of patent law, such dividing lines are also in accordance with the invention that are straight only on average because, for example, they run in a slight wiggle around a central line upon closer inspection.

The wiper lips are connected with their base section to the basic wiper body, preferably attached by injection-molding. They preferably consist of the same material as the latter. Alternatively, it is possible in some cases in which an optimally adapted result is to be achieved regardless of costs to attach the wiper lips by injection-molding while using a different, preferably more flexible plastic.

The wiper lips are designed in such a way that they are connected to the basic wiper body with one of their two longer sides. The other of the two longer sides is the substantially freely cantilevered side of the wiper lip. In the direction of the arrow P, the longer sides of these wiper lips have a length of preferably at least 10 mm, better 15 mm and ideally even more than 20 mm. Preferred embodiments even have wiper lips whose longer sides have a length of at least 25 mm.

The lip section 8 or 9 and at least one of the two wiper lips 4 or 5 is respectively divided into several bending elements 12. In the present exemplary embodiment, even the lip sections of both wiper lips are divided in such a way.

The wiper lip thus divided preferably comprises at least 10 bending elements (with the reference numeral 12), better at least 20 and ideally more than 25 bending elements. The use of more than 40 bending elements in most cases changes the characteristics of the wiper for the worse, which is acceptable at most in exceptional cases, and should preferably be avoided.

For many cases of use, it is ideal if the bending elements 12 are most predominantly or optimally completely identical.

As a rule, the bending elements are designed in such a way that they assume a defined shape and position—in contrast to a wiper consisting of individual bristles in the narrower sense, i.e. also of filaments that protrude haphazardly after repeated use at the latest.

These bending elements 12 are characterized by the fact that they can be individually bent to the side when the cosmetics applicator is pushed through or withdrawn, without transferring forces to an adjacent bending element right away.

These bending elements 12 are preferably designed like bending beams that are unilaterally connected on their side of the base section and cantilever freely into the central area of the wiper. Compared to the maximum passage length LM, these bending beams are of a very delicate design because the average width does not exceed 1.5 mm, and better still 0.75 mm. An average width in this sense refers to the width parallel to the maximum passage length LM that an imaginary rectangle should have that has the same surface area as a bending element between its free end and the place where it is connected to the base section of the associated wiper lip in the manner of a cantilever beam. All or at least the predominant number of the bending beams optimally have such a design.

Preferably, a certain gap 10 stays free between the individual adjacent bending elements 12 of one and the same wiper lip 4 or 5, i.e. adjacent bending elements 12 do not touch each other with their flanks, at least not over their entire length, preferably not at all. It is precisely for this reason that the individual bending elements 12 can be individually bent to the side to a certain extent without transferring forces to an adjacent bending element right away.

It is known that it is not desirable that cosmetic mass, which is at first located in the storage container, is able to overcome the barrier effect of the wiper if the cosmetics container is stored inappropriately (e.g. upside-down in a handbag) and advance into the area of the closure cap of the cosmetics container. In order to make allowances for this, the gaps 10, depending on the rheological properties of the cosmetic for which the wiper is intended, are all or at least substantially all (which is clearly less advantageous) are configured to be so small that the cosmetic substantially cannot overcome the gaps due to its high viscosity and/or surface tension when the cosmetics container is stored upside-down for at least 4 hours.

It can be seen in FIG. 1 that the wiper lips 4, 5, or at least their bending elements 12, are disposed relative to one another in an arrow-like manner in the direction of the interior of the cosmetics container—the tip of the arrow faces the interior of the cosmetics container. Preferably, the longitudinal axis of the lip LL, at least on the half of the wiper lip 4, 5 facing the center of the passage, includes an acute angle W with the longitudinal axis L of the passage 3, wherein the following applies for the angle: W≤70° or ideally W≤65°. Preferably, the angle should not be smaller than 50°.

Figure 7:
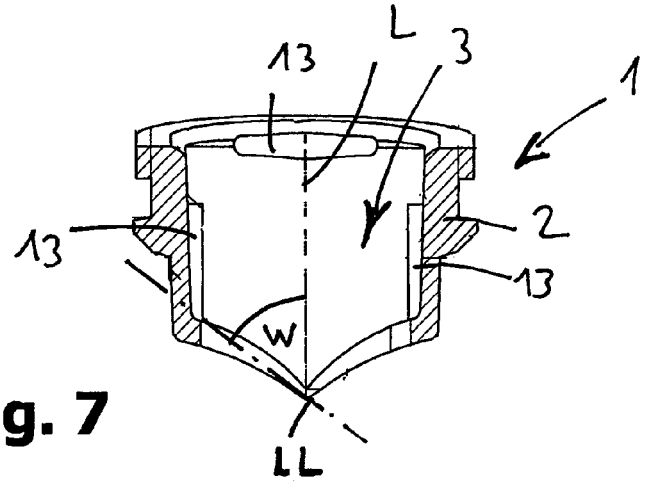
FIG. 7: a section through a third exemplary embodiment of the wiper according to the invention along the line of cut B-B.

As is explained with reference to FIG. 1 and by drawings, and as can be seen in FIG. 7, which is in this regard identical, the wiper lips preferably have a slight curvature in the direction from the base to the tip of the wiper lip, with a radius of curvature Q, for which the following applies: Q≤50 mm, better Q≤40 mm, ideally Q≤20 mm.

Expediently, it holds that the wiper lips 4, 5 or at least their bending elements 12 taper towards the center of the passage at least with regard to their width and/or their thickness, so that their geometrical moment of inertia resisting bending becomes smaller and smaller towards the center.

As can be seen, these bending elements 12 are preferably designed as triangular tongues, a number of which is disposed next to one another along a wiper lip 4 or 5. All of the statements above apply in the literal sense to these triangular tongues and the gaps 10 located between them.

The tips of these triangular tongues protrude freely. Triangular gaps are located between adjacent tongues. The triangles forming the tongues are triangles with an acute-angled side that protrudes freely. The width of the triangles in the direction of the maximum usable length LM, in the root area of the freely protruding triangle, is between 0.4 mm and 1.5 mm, preferably, the upper limit of the width is even ≤0.9 mm.

Preferably, the triangular tongues at their mutually opposing wiper lips are disposed with an offset rapport or an offset, i.e. the tips of the triangular tongues of the one wiper lip are respectively directly (by the shortest distance) opposed to the free spaces between two triangular tongues of the other wiper lip. It is thus avoided that local free spaces are produced that have such a large free cross sectional area that the barrier effect of the wiper, which is addressed elsewhere in this description, is affected.

The triangular tongues are of great advantage in particular if a flat applicator is supposed to be wiped off whose bristle covering has, in the broadest sense, a roller-shaped jacket contour, i.e. the shape of a roller whose longitudinal axis extends in the direction of the length LM and which also has a number of bristles that laterally protrude over the bristle-carrying basic body of the flat applicator. Of course, however, the wiper can also be used advantageously for non-roller-shaped applicators.

Figure 10:
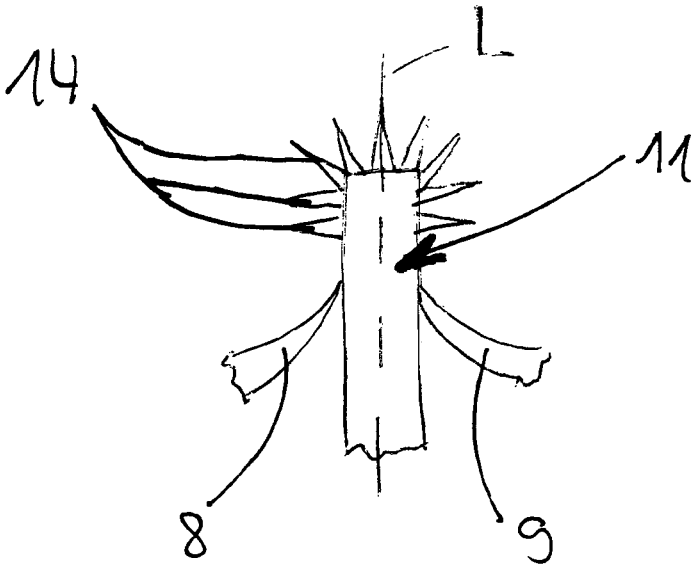
FIG. 10: schematically shows a part of an applicator in engagement with the lip section of a wiper according to one of the three previously described exemplary embodiments.
Figure 11:
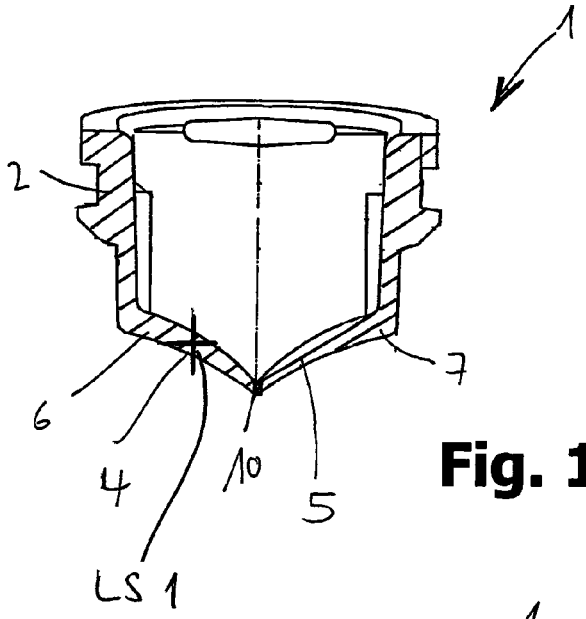
FIG. 11: shows a section through another exemplary embodiment that constitutes a second variation of the invention.
Figure 12:
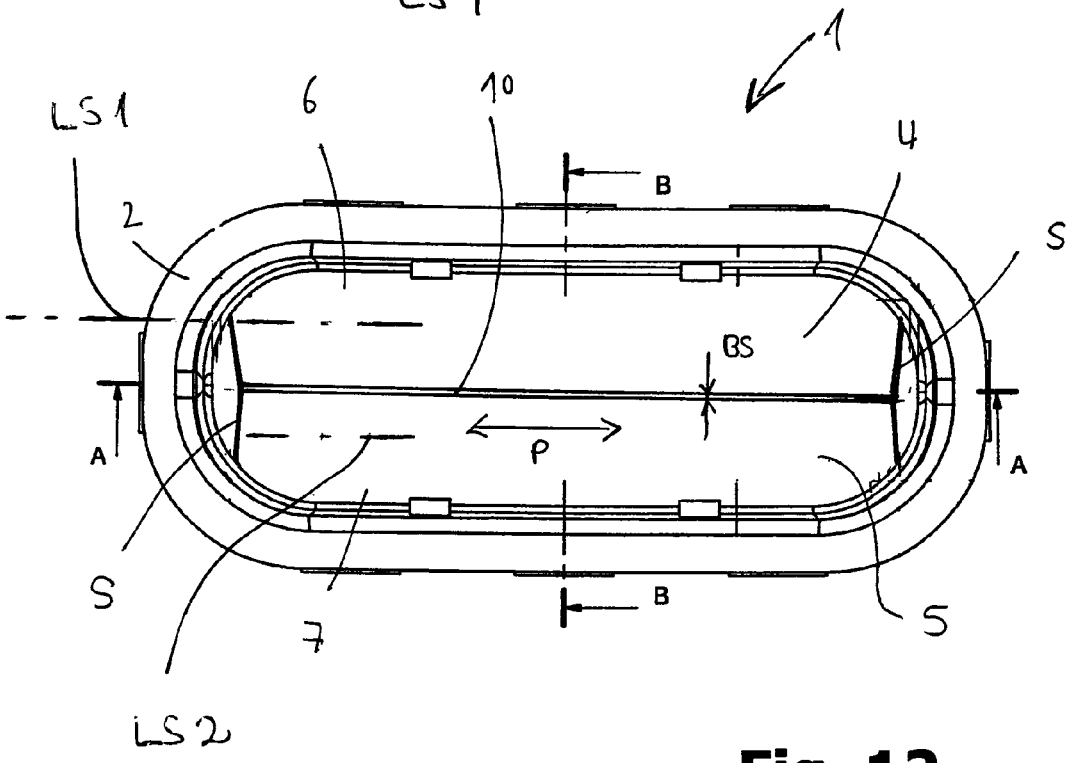
FIG. 12: shows a section through another exemplary embodiment that constitutes a second variation of the invention, seen from above.

A side view of the bristle-covered end portion of such an applicator 11 is illustrated by FIG. 10. Here, one can see how the bending elements 12 are in engagement with the bristle-carrying end portion and understand that the great advantage of the triangular tongues lies in the fact that they do not put too much stress on the laterally protruding part of the bristle covering, specifically, when the applicator is withdrawn. This is due to the fact that the triangular tongues are not capable of flattening or kinking the bristles almost perpendicularly over a wide area. Instead, the triangular tongues respectively act like a type of "flow splitter" (term borrowed from bridge construction), so that the individual bristles are given the opportunity relatively quickly of being allowed to slip into one of the gaps 10 and thus pass the wiper lip concerned without being put under excessive strain. At the same time, the laterally protruding bristle covering can thus also be "combed out" and thus be freed very effectively with the required accuracy from an excessive charge of cosmetic mass, again, see FIG. 7.

In view of this function, it is clear why the wiper or the wiper lips are preferably not supposed be manufactured from a soft-elastic material with rubber-like properties, but from a sufficiently flexible, but inherently dimensionally stable material—preferably from one of the same plastics as they are used also for the production of bristles attached to a bristle carrier by injection-molding.

At this time, a special aspect of the invention should be addressed which, if required, can be realized with great advantage:

The wiper according to the invention shows its particular strength—even if its bending elements possibly do not have the shape of triangular tongues—where it is used together with an applicator whose bristle covering is positionally exact, i.e. in which each individual bristle assumes a known base position that is reproducible in series production, and ideally also always has the same, also reproducible orientation. If it is then ensured that the wiper and the applicator always interact with each other in a defined position (or at least in a defined positional range) relative to each other, then the result is a very effective applicator-wiper-system. According to certain embodiments, the applicator wiper system may be characterized in that the cosmetics applicator is a mascara applicator formed like a flat brush whose handle is at least partially located in such an immediate manner in front of the eye during application that at least a part of the longitudinal axis of the handle extends substantially perpendicularly to the pupil.

At least the bristle positions of the individual laterally protruding bristles of the bristle covering are in that case selected and adapted to the design given to the lip section of the wiper lip in such a way that none of these bristles or at least substantially none of these bristles (seen in the direction of the maximum length LM) is in a position in which it strikes exactly the free end face of a bending element 12 or the tip of the triangular tongue when it is withdrawn, but instead stands in the area of a gap 10 and therefore lays itself into the latter without being forced to when the wiper is withdrawn. Bristles that, while the applicator is pulled out through the wiper, lay themselves into the latter's gaps 10 are made to curve significantly less sharply by the wiper than such bristles that are more or less "perpendicularly flattened" during withdrawal by a continuous wiper lip of a wiper that is not in accordance with the invention. Used properly and adapted to the bristle covering of the applicator, the wiper according to the invention goes very easy on the bristle covering and therefore permits even bristle designs that are more susceptible to kinking. Even if only less kinking-susceptible bristle designs are being used, the wiper according to the invention shows its strength, for it is clearly evident that the forces to be overcome during withdrawal of the applicator are the smaller the less sharply the bristles are bent when passing the wiper lip.

It is important to note that the applicator according to the invention in many cases shows its strength at least to a significant extent when the positions of the individual bristles are not exactly adapted to the wiper design in the manner described above.

In order to ensure, in the case of the above-described optimization, a relative position between the applicator and the wiper that always remains the same or is subject to sufficiently tight tolerances, the basic wiper body 2 is provided with guiding organs that ensure the sufficiently exact positioning of the applicator relative to the wiper. These guiding organs can be seen well in FIGS. 1 to 3; in this case, they are designed in the shape of guiding strips 13 raised relative to the inner wall of the basic wiper body 2. Preferably, these guiding organs are designed or disposed in such a way that they exhibit a guiding effect both in the direction of the maximum usable length LM as well as in the direction of the maximum usable width BM. Alternatively, it would be conceivable that the inner wall of the basic wiper body as such could also assume the guiding function, more or less over its entire surface. In the case of a sliding movement along one another more or less over the entire surface, however, the danger of undesired smearing/trailing of cosmetic mass occurring on the applicator is great. Such a full-surface guidance is in accordance with the invention only to a peripheral extent, it is not, however, preferred.

At least one or two of said guiding organs 13 are preferably designed in such a way that they latch with the applicator when the latter has reached its end position relative to the wiper. In this manner, the applicator is securely retained in its resting position.

The wiper lips are designed and arranged in such a way that they meet or almost meet at their end facing the center of the passage, i.e. that they come close to one another but for a small distance of maximally 9/10 mm. Thus, the free tips of the triangular tongues of the one wiper lip almost or nearly meet, in the above-mentioned sense, with the tips of the triangular tongues of the other wiper lip.

Figure 4:
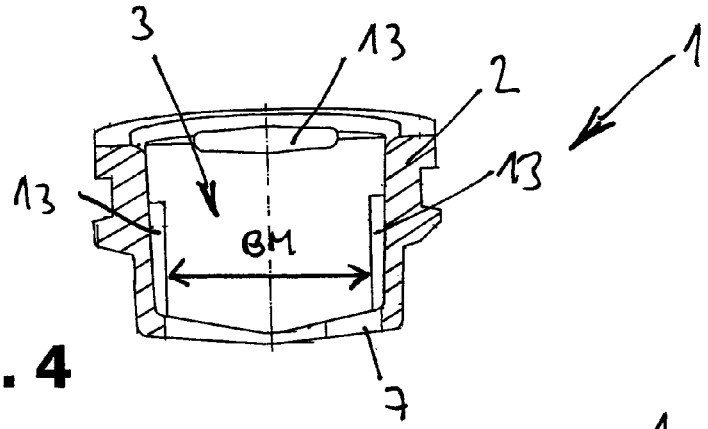
FIG. 4: a section through a second exemplary embodiment of the wiper according to the invention along the line of cut B-B.
Figure 5:
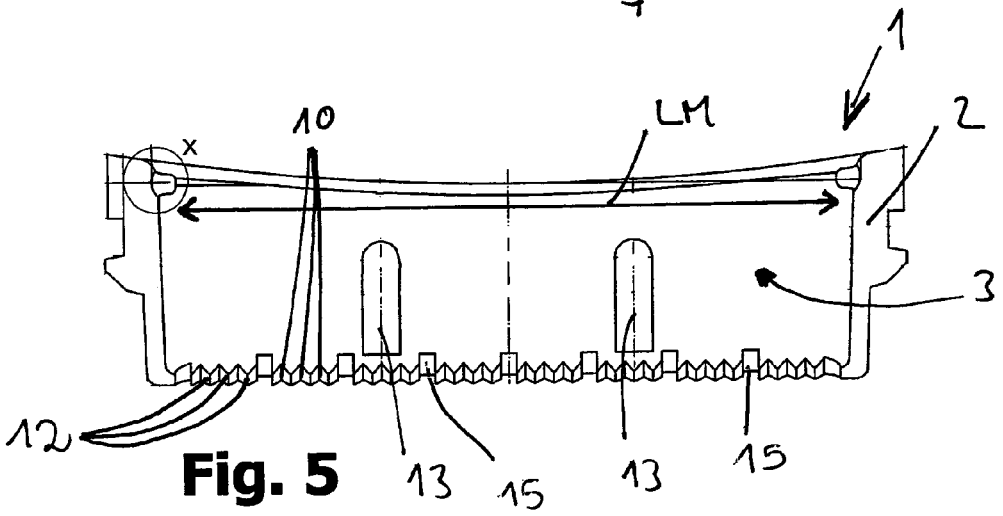
FIG. 5: a section of the second exemplary embodiment along the line of cut A-A.
Figure 6:
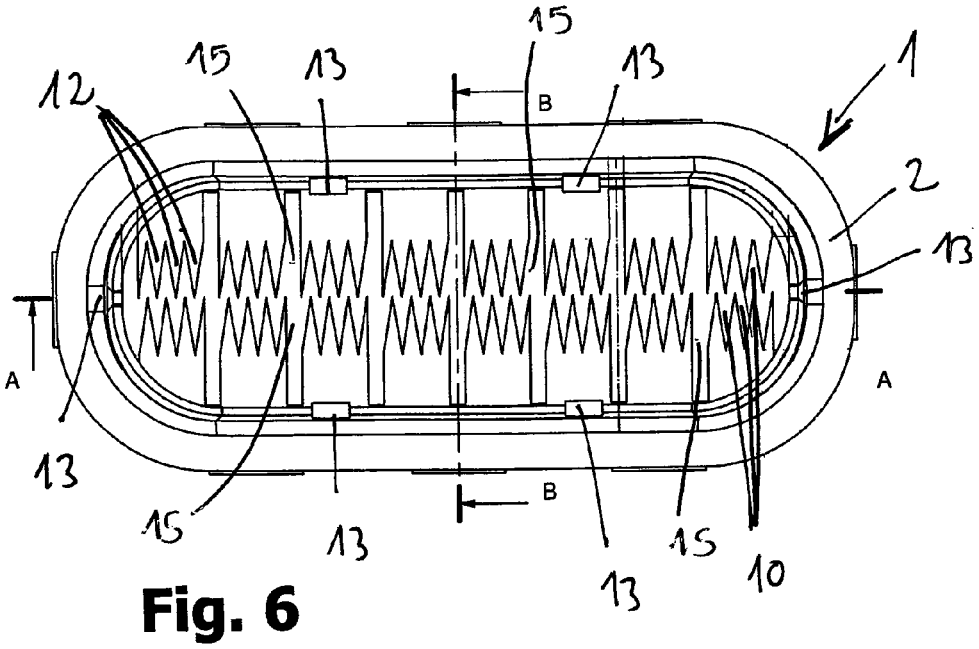
FIG. 6: a top view of a wiper according to the second exemplary embodiment.

A second exemplary embodiment of the wiper according to the invention is shown in FIGS. 4 through 6. The statements made above with regard to the first exemplary embodiment apply entirely also to this second exemplary embodiment, with the following modifications:

In addition to the bending elements 12 of the type mentioned above, the wiper lips 4, 5 in this exemplary embodiment also comprise at least one, preferably several cuts 15, which run into the base section 6 or 7 of the respective wiper lip or completely through it. The cuts are preferably designed in such a way that the flanks of the wiper lips rimming the respective cut do not touch but enclose a free space between them.

If several cuts 15 are provided on a wiper lip, the wiper lip is divided by it into several flexible tabs 16 that are substantially independent from one another, each of which carries several of the above-described bending elements 12. An even greater flexibility of the wiper lip is thus accomplished. Optionally, a path is thus produced which does not tend to jam with wiped-off cosmetics even after a longer period of use, through which a better pressure equalization can occur, so that no or only a smaller negative pressure forms in the cosmetics container during the withdrawal of the wiper (pumping effect), which makes withdrawal difficult and, in the most disadvantageous case, leads to the cosmetic being dislocated. In that case, similar advantages are evident during the reinsertion of the applicator through the wiper.

Otherwise, this exemplary embodiment differs from the first exemplary embodiment only by the angle W between the longitudinal axis of the lips LL and the longitudinal axis L of the passage being selected so as to be smaller. The following applies to the angle W in this exemplary embodiment: $W \leq 85°$ or ideally $W \leq 80°$. Preferably, the angle should not be smaller than 50° in this case either, ideally, $W \geq 60°$ applies here.

Figure 8:
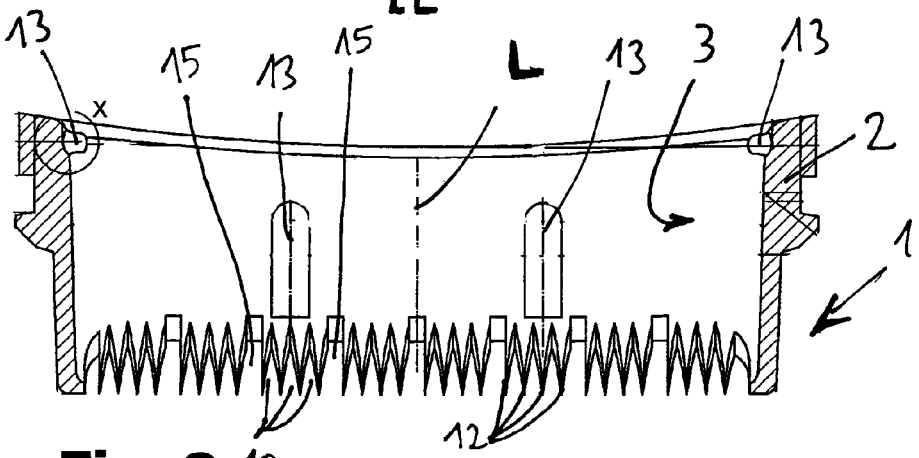
FIG. 8: a section of the third exemplary embodiment along the line of cut A-A.
Figure 9:
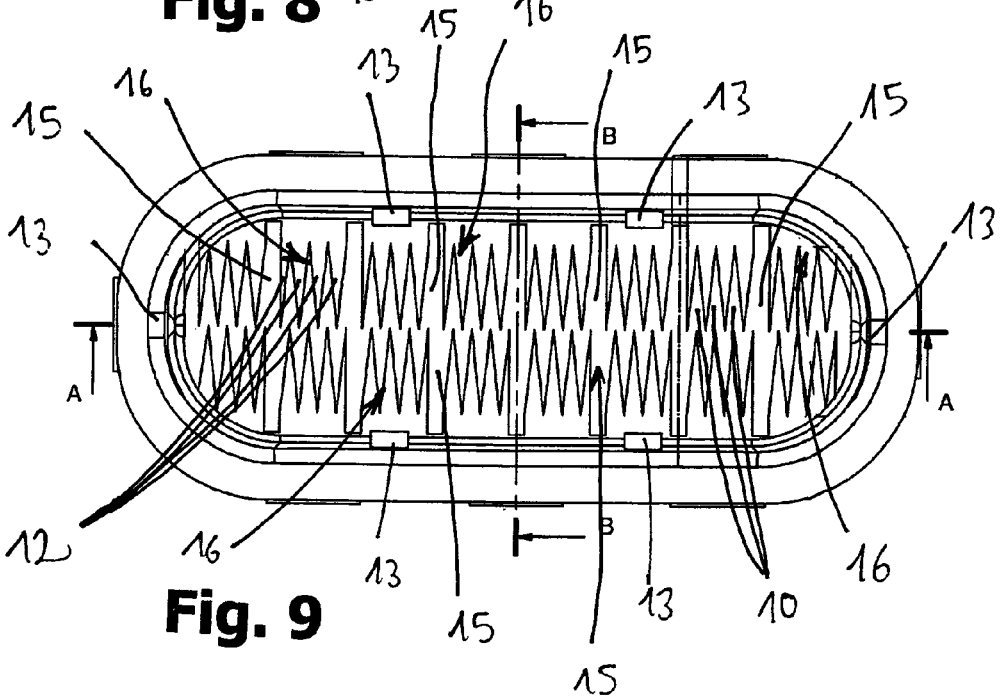
FIG. 9: a top view of a wiper according to the third exemplary embodiment.

A third exemplary embodiment of the wiper according to the invention is shown in FIGS. 7 through 9. The statements made above with regard to the first and second exemplary embodiments apply entirely also to this third exemplary embodiment. The sole difference between the second and this third embodiment is the fact that the angle W of the third exemplary embodiment matches that of the first exemplary embodiment.

Preferably, protection is sought also for a second variation of the invention, independent from the above-described first variation of the invention.

This independent second variation of the invention is a wiper for wiping off a cosmetics applicator designed exactly like the above-described wiper, with the sole difference, however, that the two mutually opposing wiper lips are not themselves divided into several bending elements, but are designed as uniform continuous wiper lips. Therefore, all of the statements above equally apply for this further wiper. Only the statements regarding the division of each of the wiper lips into several bending elements do not apply to this wiper; otherwise, the following description is also applicable without any modifications to this wiper.

This further invention, which is to be explained in more detail below, can therefore be a wiper, for example, which is designed as follows:

Wiper for wiping off a cosmetics applicator during withdrawal from a storage container, the wiper forming a substantially rectangular passage, which in the non-stressed state is closed off by two mutually opposing wiper lips. In this case, the wiper lips respectively have—at least substantially—the shape of a rectangle which is connected, with one of its longer sides, to the basic wiper body, and which interacts with the cosmetics applicator with the other of its longer sides in order to wipe off the applicator. Thus, these wiper lips substantially also have the shape of a straight strip. It generally also applies to this variation that only two such wiper lips are preferably used, and no other ones.

Preferably, these wiper lips, in the withdrawn state of the cosmetics applicator, touch along a straight connecting line, or they enclose between them, in the withdrawn state of the applicator, a line-shaped gap with a width BS of no more than 1 mm, and preferably of no more than 0.6 mm.

Most frequently, it is provided according to the invention also in this case that the wiper lips in the non-stressed state have a contour in the direction of its longitudinal axes LS 1 or LS 2 that is at least substantially, preferably even completely straight, apart from tolerance-related deviations or deformations caused by the period of use. The contour may be referred to as being substantially straight if the average radius of curvature of the longitudinal axes is less than 40 mm and preferably even less than 60 mm. Preferably, said longitudinal axes LS 1 and 2 extend parallel to the dividing line T between the wiper lips.

In the direction of the arrow P, said longer sides of these wiper lips have a length of preferably at least 10 mm, better 15 mm and ideally even more than 20 mm. Preferred embodiments even have wiper lips whose longer sides have a length of at least 25 mm.

Preferably, the wiper lip is separated in the area of its narrow sides, i.e. in the area of its front and rear end, from the basic wiper body 2 by a lateral gap S, so that the wiper lips actually are substantially connected to the basic wiper body 2 only along their one longer side. It is thus ensured that the wiper lips are sufficiently yielding even if they are not divided into individual segments.

In a direction transverse to the direction of said longer sides, the thickness of each wiper lip decreases in the direction towards the longer side with which the wiper lip interacts directly with the cosmetics applicator. For this reason, each of the wiper lips basically has the shape of a bending carrier tapering towards its free end, exactly as in the first exemplary embodiment in this respect.

In summary, protection is sought independently for the following wipers, for example: Wiper for wiping off a cosmetics applicator, the wiper 1 forming a substantially rectangular passage 3, which in the non-stressed state is closed off by two mutually opposing wiper lips 4, 5 that are respectively configured as a continuous, undivided strip that is preferably straight along the lip's longitudinal axis LS1 or LS2, which is elastically deformed when the cosmetics applicator is pushed through and thus clears the way for the applicator to pass through the passage 3.

This wiper is designed in such a way that, during its deformation when a cosmetics applicator is pushed through, substantially only such bending moments or bending stresses act which produce bending about imaginary axes that lie parallel in space relative to one another, so that the respective wiper lip behaves like a wide bending beam which, however, is plane in the width direction.

The invention claimed is:

1. A wiper for wiping off a cosmetics applicator during the withdrawal from its storage container, the wiper comprising:

two mutually opposing wiper lips, wherein the wiper forms a substantially rectangular passage, which in a non-stressed state is closed off by the two mutually opposing wiper lips; and the two mutually opposing wiper lips are respectively divided into a plurality of bending elements which are elastically deformed when a cosmetics applicator is pushed through and thus clear a way for the applicator to pass through the passage;

wherein a thickness of the bending elements, measured in a direction of the longitudinal axis of the bending elements, decreases from a root of the bending element towards a free end of the bending element.

2. A wiper according to claim 1, wherein at least some of the bending elements form a first section of at least one of the wiper lips and transition into a base section of the respective wiper lip that forms a second section of the respective wiper lip.

3. A wiper according to claim 1, wherein two or more bending elements of a wiper lip, adjacent to their root, unify to form a combined tab.

4. A wiper according to claim 1, wherein triangular tongues of mutually opposing wiper lips are disposed with an offset rapport or with an offset.

5. A wiper according to claim 1, wherein a longitudinal axis (LL) of the bending elements is inclined at an angle (W) of 85° to 50° relative to a longitudinal axis (L) of the wiper.

6. A wiper according to claim 1, wherein a free space is provided between adjacent bending elements, this free space having a triangular form.

7. A wiper according to claim 1, wherein the bending elements, at least in some sections, respectively consist of triangular tongues.

8. A wiper according to claim 7, wherein a narrowest side of the triangular tongues respectively forms a root with which the triangular tongues are respectively connected to the rest of the body of the wiper in a manner of unilaterally cantilevered bending beams.

9. A wiper according to claim 1, wherein a sleeve forming a predominant part of the wiper has a maximum height (HM) of up to 18 mm.

10. A wiper according to claim 9, wherein the sleeve forming a predominant part of the wiper forms a passage which, in a first direction perpendicular to a longitudinal axis (L) of the wiper, has a usable maximum length (LM) of 15 mm to 40 mm.

11. A wiper according to claim 10, wherein the sleeve forming a predominant part of the wiper forms a passage which, in a second direction perpendicular to a first direction and to the longitudinal axis of the wiper, has a maximum usable width of 2.5 mm to 10 mm.

12. A wiper according to claim 1, wherein the wiper comprises guiding strips, which determine a position in which the wiper and the applicator are relative to each other when the applicator is inserted into the wiper or is fixed therein.

13. A cosmetics applicator system, comprising a cosmetics applicator with a bristle covering of injection-molded bristles and a wiper for wiping off a cosmetics applicator during the withdrawal from its storage container, the wiper comprising two mutually opposing wiper lips, wherein the wiper forms a substantially rectangular passage, which in a non-stressed state is closed off by the two mutually opposing wiper lips; and the two mutually opposing wiper lips are respectively divided into a plurality of bending elements which are elastically deformed when a cosmetics applicator is pushed through and thus clear a way for the applicator to pass through the passage, wherein a placement of laterally protruding bristles of the bristle covering is selected and adapted to a design given to a lip section of the wiper lips in such a way that substantially none of these bristles (seen in a direction of a maximum length (LM)) is in a position in which a bristle strikes exactly a free end face of a bending element or a tip of a triangular tongue when the bristle is withdrawn, but instead stands in an area of a gap and therefore lays itself into the area of the gap without being forced to when the wiper is withdrawn.

14. A cosmetics applicator system, comprising a cosmetics applicator with a bristle covering of injection-molded bristles and a wiper according to claim 1, wherein the cosmetics applicator is a mascara applicator formed like a flat brush whose handle is at least partially located in such an immediate manner in front of a user's eye during application that at least a part of a longitudinal axis of the handle extends substantially perpendicularly to the user's pupil.

* * * * *